US007846074B2

(12) United States Patent
Wu

(10) Patent No.: US 7,846,074 B2
(45) Date of Patent: Dec. 7, 2010

(54) RECUMBENT EXERCISER

(75) Inventor: Shen-Yi Wu, Taichung (TW)

(73) Assignee: Strength Master Fitness Tech. Co., Ltd., Taichung (TW)

( * ) Notice: Subject to any disclaimer, the term of this patent is extended or adjusted under 35 U.S.C. 154(b) by 0 days.

(21) Appl. No.: 12/289,627

(22) Filed: Oct. 31, 2008

(65) Prior Publication Data

US 2010/0113228 A1 May 6, 2010

(51) Int. Cl.
*A63B 21/00* (2006.01)
*G09B 9/06* (2006.01)

(52) U.S. Cl. ..... 482/72; 482/92; 482/138; 434/60

(58) Field of Classification Search ..... 482/51, 482/57, 72, 92, 111, 114, 132, 142, 138, 482/140; 434/60
See application file for complete search history.

(56) References Cited

U.S. PATENT DOCUMENTS 641,596 A * 1/1900 Kerns ..... 482/72
1,111,269 A * 9/1914 Medart ..... 482/72
1,504,375 A * 8/1924 Phillips ..... 482/73
1,707,791 A * 4/1929 Anderson ..... 482/72
1,905,092 A * 4/1933 Hardy ..... 482/72
3,266,801 A * 8/1966 Johnson ..... 482/73
3,473,843 A * 10/1969 Hart ..... 297/130
3,528,653 A * 9/1970 Ross et al. ..... 482/72
3,589,720 A * 6/1971 Agamian ..... 482/114
3,912,264 A * 10/1975 Busse et al. ..... 482/72
D277,304 S * 1/1985 Smith et al. ..... D21/674
4,563,000 A * 1/1986 Gall ..... 482/72
D287,389 S * 12/1986 Nadeau ..... D21/674
4,684,126 A * 8/1987 Dalebout et al. ..... 482/138
4,743,010 A * 5/1988 Geraci ..... 482/72
4,743,011 A * 5/1988 Coffey ..... 482/73
4,750,736 A * 6/1988 Watterson ..... 482/73
D297,853 S * 9/1988 Ostrom ..... D21/674
D306,750 S * 3/1990 Kiiski ..... D21/674
4,974,832 A * 12/1990 Dalebout ..... 482/72
5,104,363 A * 4/1992 Shi ..... 482/73
D337,799 S * 7/1993 Cutter et al. ..... D21/674
D354,099 S * 1/1995 Gerschefske et al. ..... D21/668
5,387,169 A * 2/1995 Wang ..... 482/73
D357,041 S * 4/1995 McBride et al. ..... D21/676
5,407,409 A * 4/1995 Tang ..... 482/70
D358,624 S * 5/1995 Wang et al. ..... D21/673
5,441,469 A * 8/1995 Chern ..... 482/72
D362,283 S * 9/1995 Lee ..... D21/674

(Continued)

*Primary Examiner*—Steve R Crow
*Assistant Examiner*—Robert F Long
(74) *Attorney, Agent, or Firm*—Rosenberg, Klein & Lee

(57) ABSTRACT

A recumbent exerciser includes a base, a right link and a left link are pivotably connected to the base and a right cam and a left cam are connected to the right link and the left link respectively. A right pedal and a left pedal are connected to two respective top ends of the right link and the left link, and a right swinging arm and a left swinging arm are connected to the right link and the left link. A resistance unit provides resistance to the right and left pedals and the right left swinging arms when the right and left cams are driven by operation of the user so as to exercise the user's hands and legs. The resistance unit is located remote from the seat so that the seat does not need to remove to maintain the resistance unit and the cams.

7 Claims, 9 Drawing Sheets

U.S. PATENT DOCUMENTS 5,478,296 A * 12/1995 Lee ..... 482/73
5,505,679 A * 4/1996 McBride et al. ..... 482/53
5,554,086 A * 9/1996 Habing et al. ..... 482/137
D375,767 S * 11/1996 Camfield et al. ..... D21/668
5,575,740 A * 11/1996 Piaget et al. ..... 482/70
5,580,340 A * 12/1996 Yu ..... 482/96
D378,110 S * 2/1997 Collinsworth ..... D21/690
5,611,758 A * 3/1997 Rodgers, Jr. ..... 482/57
D390,289 S * 2/1998 Chen ..... D21/668
5,722,921 A * 3/1998 Simonson ..... 482/100
5,779,600 A * 7/1998 Pape ..... 482/72
5,795,270 A * 8/1998 Woods et al. ..... 482/72
D397,745 S * 9/1998 Wu ..... D21/668
D414,519 S * 9/1999 Wang et al. ..... D21/676
6,042,518 A * 3/2000 Hildebrandt et al. ..... 482/57
D425,585 S * 5/2000 Wu ..... D21/676
6,071,215 A * 6/2000 Raffo et al. ..... 482/57
6,093,135 A * 7/2000 Huang ..... 482/72
6,135,930 A * 10/2000 Kuo ..... 482/72
6,162,153 A * 12/2000 Perez et al. ..... 482/96
6,196,954 B1 * 3/2001 Chen ..... 482/131
6,224,519 B1 * 5/2001 Doolittle ..... 482/98
6,238,321 B1 * 5/2001 Arnold et al. ..... 482/52
6,361,479 B1 * 3/2002 Hildebrandt et al. ..... 482/72
6,371,895 B1 * 4/2002 Endelman et al. ..... 482/135
6,540,650 B1 * 4/2003 Krull ..... 482/107
6,565,495 B2 * 5/2003 Slattery ..... 482/142
6,602,168 B2 * 8/2003 Duke ..... 482/72
6,692,410 B1 * 2/2004 Lai ..... 482/52
7,232,404 B2 * 6/2007 Nelson ..... 482/140
7,252,627 B2 * 8/2007 Carter ..... 482/98
7,413,532 B1 * 8/2008 Monsrud et al. ..... 482/99
7,455,633 B2 * 11/2008 Brown et al. ..... 482/142
D584,367 S * 1/2009 Augustine et al. ..... D21/662
2001/0023219 A1 * 9/2001 Arnold et al. ..... 482/57
2002/0151415 A1 * 10/2002 Hildebrandt et al. ..... 482/57
2003/0045406 A1 * 3/2003 Stone ..... 482/100
2005/0032611 A1 * 2/2005 Webber et al. ..... 482/72
2005/0130810 A1 * 6/2005 Sands ..... 482/72
2006/0166798 A1 * 7/2006 Nelson ..... 482/140
2007/0149370 A1 * 6/2007 Brown et al. ..... 482/140
2007/0197347 A1 * 8/2007 Roach ..... 482/72
2008/0020902 A1 * 1/2008 Arnold ..... 482/51
2008/0070765 A1 * 3/2008 Brown et al. ..... 482/140
2008/0070766 A1 * 3/2008 Brown et al. ..... 482/140
2008/0125291 A1 * 5/2008 Watt et al. ..... 482/52
2009/0018000 A1 * 1/2009 Brown et al. ..... 482/140

* cited by examiner

RECUMBENT EXERCISER

FIELD OF THE INVENTION

The present invention relates to an exerciser, and more particularly, to a recumbent exerciser which is easily maintained and is able to provide full range of exercise to user's hands and legs.

BACKGROUND OF THE INVENTION

A conventional recumbent exerciser generally includes a base on the floor and a frame is connected on the base, a treading mechanism is connected to the frame so that the user can operate two pedals. A swinging mechanism is located on a mediate portion of the frame and includes two co-axially installed arms to which the user's hands hold and swing to exercise both hands and feet.

However, the resistance is generated only when the swinging arms move to a specific direction and there will be no resistance when the swinging arms move toward the opposite direction.

U.S. Pat. No. 6,361,479 discloses a recumbent total body exerciser which includes two pedals on the front section of the base and the operation of the pedals drives a cam mechanism and a resistance unit located at the rear section of the base. The seat is located at a top on the cam mechanism and the resistance unit.

Nevertheless, the two pedals are operated to drive a single cam so that the trace that the pedals travel may not be smooth because the profile of the cam is not symmetrically designed and the center of the cam is not well positioned on the desired position.

Furthermore, the cam mechanism and the resistance unit are located beneath the seat and a cover has to be installed to hide the user's clothes from the cam mechanism, so that the cover and the seat have to be removed when maintaining the cam mechanism and the resistance unit. The cam mechanism and the resistance unit include complicated structure which requires a significant time to be maintained.

The present invention intends to provide a recumbent exerciser which improves the shortcomings of the conventional recumbent exerciser.

SUMMARY OF THE INVENTION

The present invention relates to a recumbent exerciser which comprises a base having a front section and a rear section, a right link and a left link are pivotably connected on two sides of the base and located at the front section of the base. A right cam and a left cam are connected to the right link and the left link respectively. A right pedal and a left pedal are connected to two respective top ends of the right link and the left link. A right swinging arm and a left swinging arm are connected to the right link and the left link. The right link and the left link can be pivoted to drive the right cam, the left cam, the right swinging arm and the left swinging arm by operation of the right pedal and the left pedal. A resistance unit is connected to the front section of the base and driven by a passive wheel which includes two respective one-way bearings on two sides thereof. The right cam and the left cam are connected to the two respective one-way bearings by a right belt and a left belt respectively. The right cam and the left cam drive the passive wheel in one direction and drive the resistance unit to generate a resistance when the right link and the left link are operated to drive the right cam and the left cam.

A seat is connected to the rear section of the base and located remote from the resistance unit.

Besides, the right link and the left link have a first push link and a second push link connected to two respective distal ends thereof respectively, and the right swinging arm and the left swinging arm are pivotably connected to the two sides of the front section of the base by two respective lower ends thereof. Two respective top ends of the right swinging arm and the left swinging arm have a right grip and a left grip connected thereto respectively. A first connection link and a second connection link are respectively connected to two respective lower ends of the right swinging arm 41 and the left swinging arm, the right swinging arm and the left swinging arm are driven by the right link and the left link so as to move toward a direction opposite to a direction that the right link and the left link move.

The primary object of the present invention is to provide a recumbent exerciser which includes two cams so as to provide consistent resistance to the pedals and the swinging arms.

Another object of the present invention is to provide a recumbent exerciser wherein the direction that the pedals are operated is opposite to the direction that the swinging arms move.

Yet another object of the present invention is to provide a recumbent exerciser wherein the transmission unit and the resistance unit are located at different positions from the seat so that the seat does not need to be removed from the base when maintaining the transmission unit and the resistance unit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
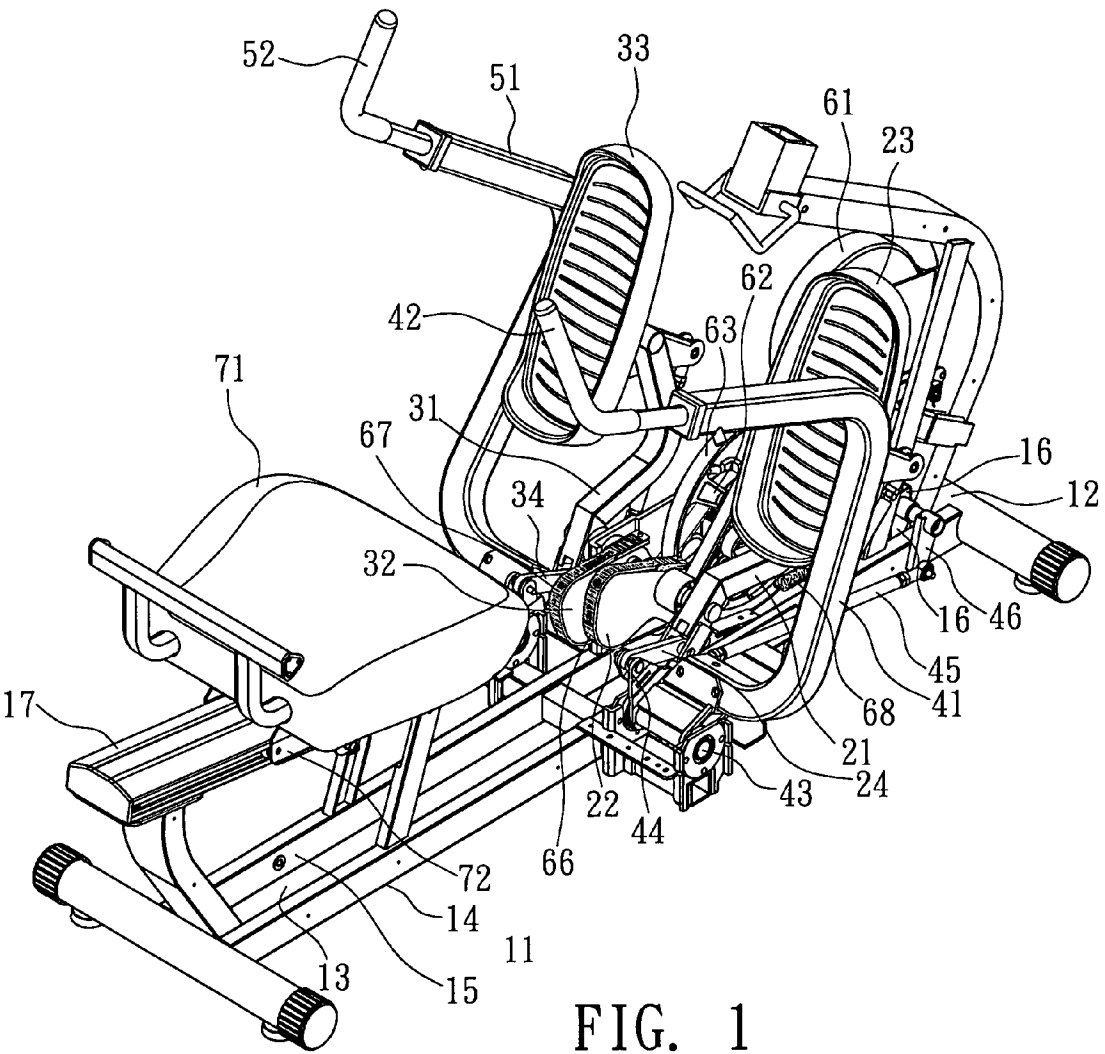
FIG. 1 is a perspective view to show the recumbent exerciser of the present invention.

Referring to FIGS. 1 to 6, the recumbent exerciser of the present invention comprises a base 11, a right link 21, a left link 31, a right swinging arm 41, a left swinging arm 51, a resistance unit 61 and a seat 71.

The base 11 includes a front section 12 and a rear section 13, and is composed of a right frame 14 and a left frame 15 which is parallel to the right frame 14.

The mediate portion of the right link 21 is pivotably connected on the right side of the base 11 and located at the front section 12 of the base 11. A right cam 22 is connected to the right link 21 on the right frame 14 and a right pedal 23 is connected to the top end of the right link 21. The right link 21 has a first push link 24 connected to a distal end thereof and the right link 21 is driven by the right pedal 23 to drive the right cam 22.

The mediate portion of the left link 31 is pivotably connected on the left side of the base 11 and located at the front section 12 of the base 11. A left cam 32 is connected to the left link 31 on the left frame 15 and a left pedal 33 is connected to the top end of the left link 31. The left link 31 has a second push link 34 connected to a distal end thereof and the left link 31 is driven by the left pedal 33 to drive the left cam 32.

The right swinging arm 41 has a right grip 42 connected to its top end thereof and a lower end of the right swinging arm 41 is pivotably connected to the right side of the base 11 by the right pivot 43. A first connection link 44 is connected to the distal end of the right swinging arm 41 and is connected to the first push link 24 of the right link 21. When the right link 21 is operated, the first push link 24 pushes the first connection link 44 so as to move the right swinging arm 41 toward a direction that is opposite to the direction that the right link 21 moves. The right link 21 is pivotably connected to the first end of a right rod 45, the second end of the right rod 45 is pivotably connected to a right crank 46. The right crank 46 is pivotably connected to the right side of the crank frame 16 on the front section 12 of the base 11.

The left swinging arm 51 has a left grip 52 connected to its top end thereof and a lower end of the left swinging arm 51 is pivotably connected to the left side of the base 11 by the left pivot 53. A second connection link 54 is connected to the distal end of the left swinging arm 51 and is connected to the second push link 34 of the left link 31.

When the left link 31 is operated, the second push link 34 pushes the second connection link 54 so as to move the left swinging arm 51 toward a direction that is opposite to the direction that the left link 31 moves. The left link 31 is pivotably connected to the first end of a left rod 55, the second end of the left rod 55 is pivotably connected to a left crank 56. The left crank 56 is pivotably connected to the left side of the crank frame 16 on the front section 12 of the base 11. By this way, the right and left cranks 46, 56 can be operated as bicycle cranks.

The resistance unit 61 is connected to the front section 12 of the base 11 and driven by a passive wheel 62. In this embodiment, the resistance unit 61 is a weight wheel which is connected to the passive wheel 62 by a transmission belt 63, so that the passive wheel 62 can activates the operation of the resistance unit 61. An idler pulley 64 presses the transmission belt 63 to ensure that the transmission belt 63 has proper tension. Two respective one-way bearings 65 are located on two ends of the axle of the passive wheel 62 and the right cam 22 and the left cam 32 are connected to the two respective one-way bearings 65 by a right belt 66 and a left belt 67 respectively. In this embodiment, the right belt 66 and the left belt 67 are two timing belts. The right belt 66 and the left belt 67 have two respective first ends fixed to the right cam 22 and the left cam 32 respectively and two respective second ends of the right belt 66 and the left belt 67 go through the one-way bearings 65 and are connected to two respective springs 68 so as to be connected to the front section 12 of the base 11. At least one idler pulley 69 presses each of the right belt 66 and the left belt 67. When the right cam 22 and the left cam 32 are rotated by the operation of the right pedal 23 and the left pedal 33, the right and left cams 22, 32 are rotated in opposite directions so as to individually drive the passive wheel 62 to generate a resistance.

The seat 71 is connected to the rear section 13 of the base 11 and located remote from the resistance unit 61. The seat 71 includes rails 72 which is movably and adjustably connected to the connection unit 17 on the base 11.

Figure 2:
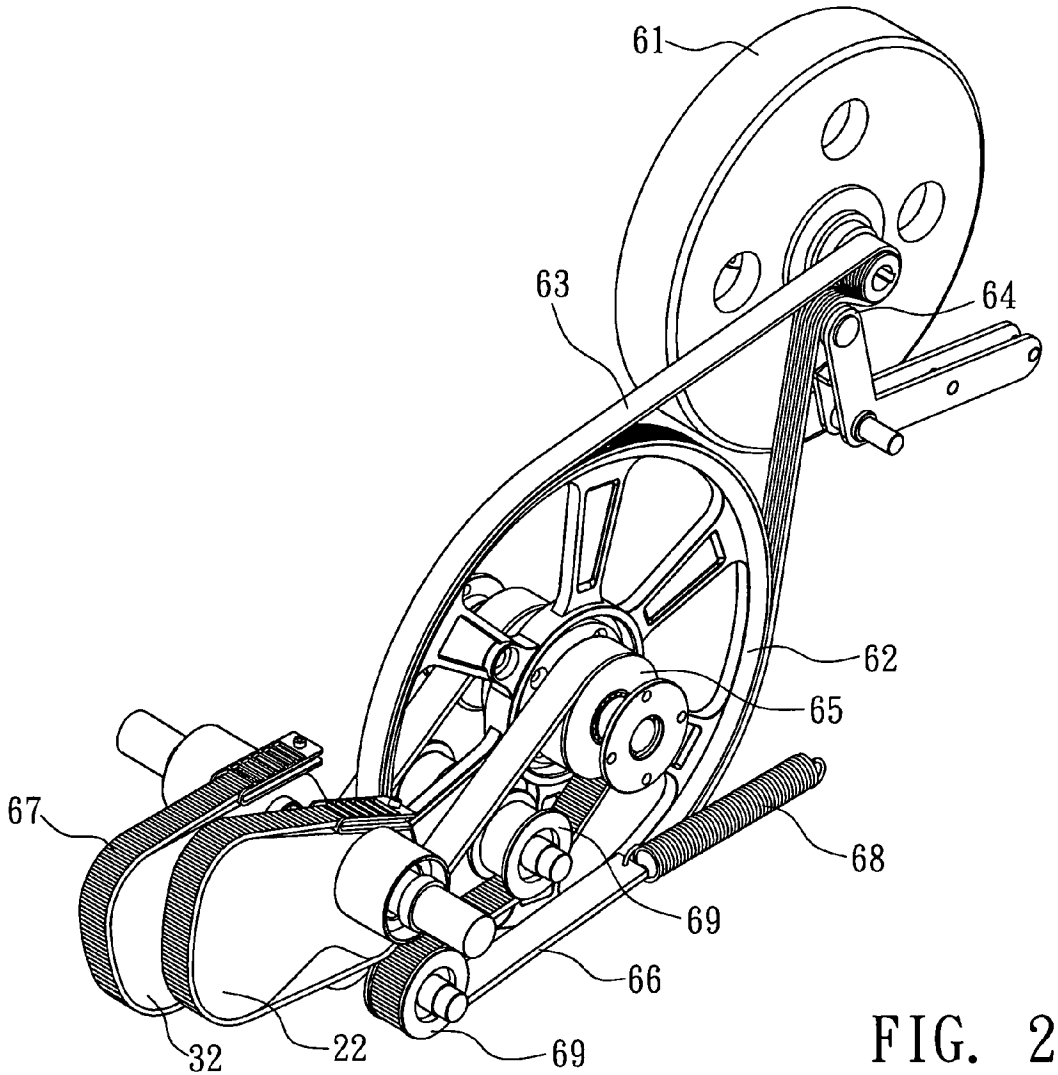
FIG. 2 is a perspective view to show the resistance unit and the cams of the exerciser of the present invention.
Figure 3:
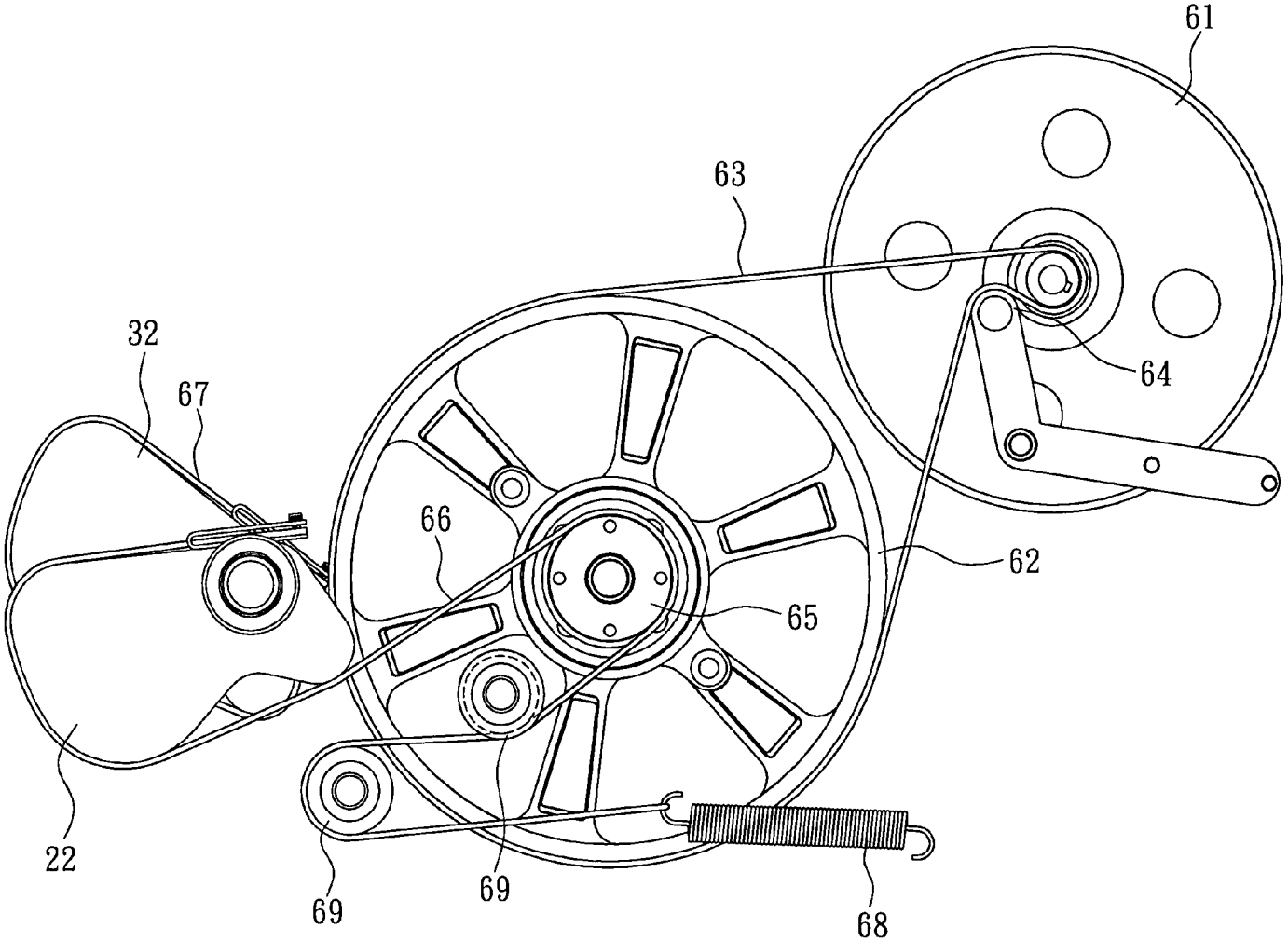
FIG. 3 shows the initial status of the right cam before it is operated.
Figure 4:
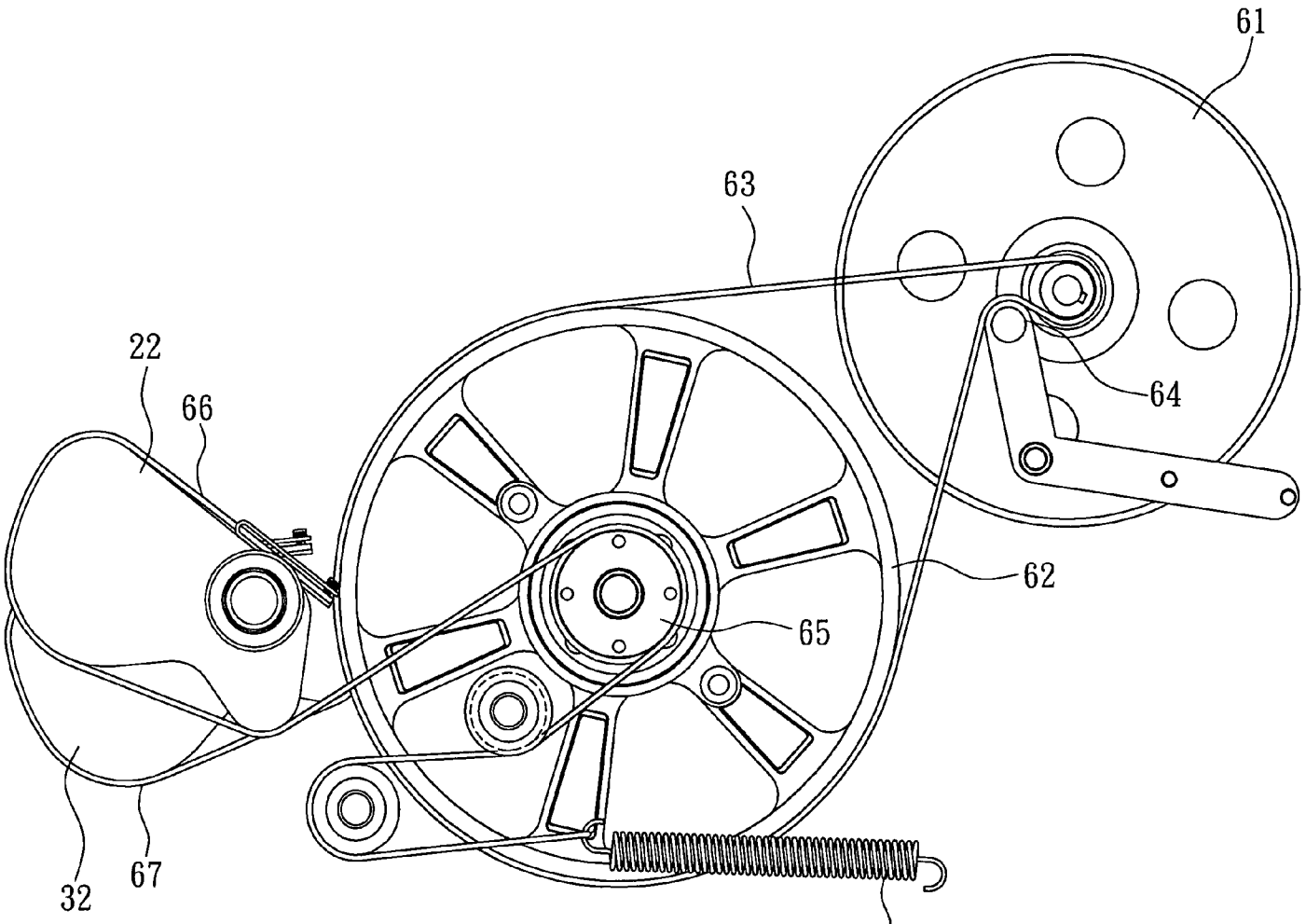
FIG. 4 shows that the right cam is rotated when the right pedal is operated.

As shown in FIGS. 2 to 4, when the right pedal 23 is moved downward, the top end of the right link 21 moves forward and the right cam 22 rotates downward so that the right belt 66 connected to the right cam 22 is driven by the right cam 22 and activates the passive wheel 62 and the resistance unit 61 to generate a resistance to exercise the user's muscles.

Figure 5:
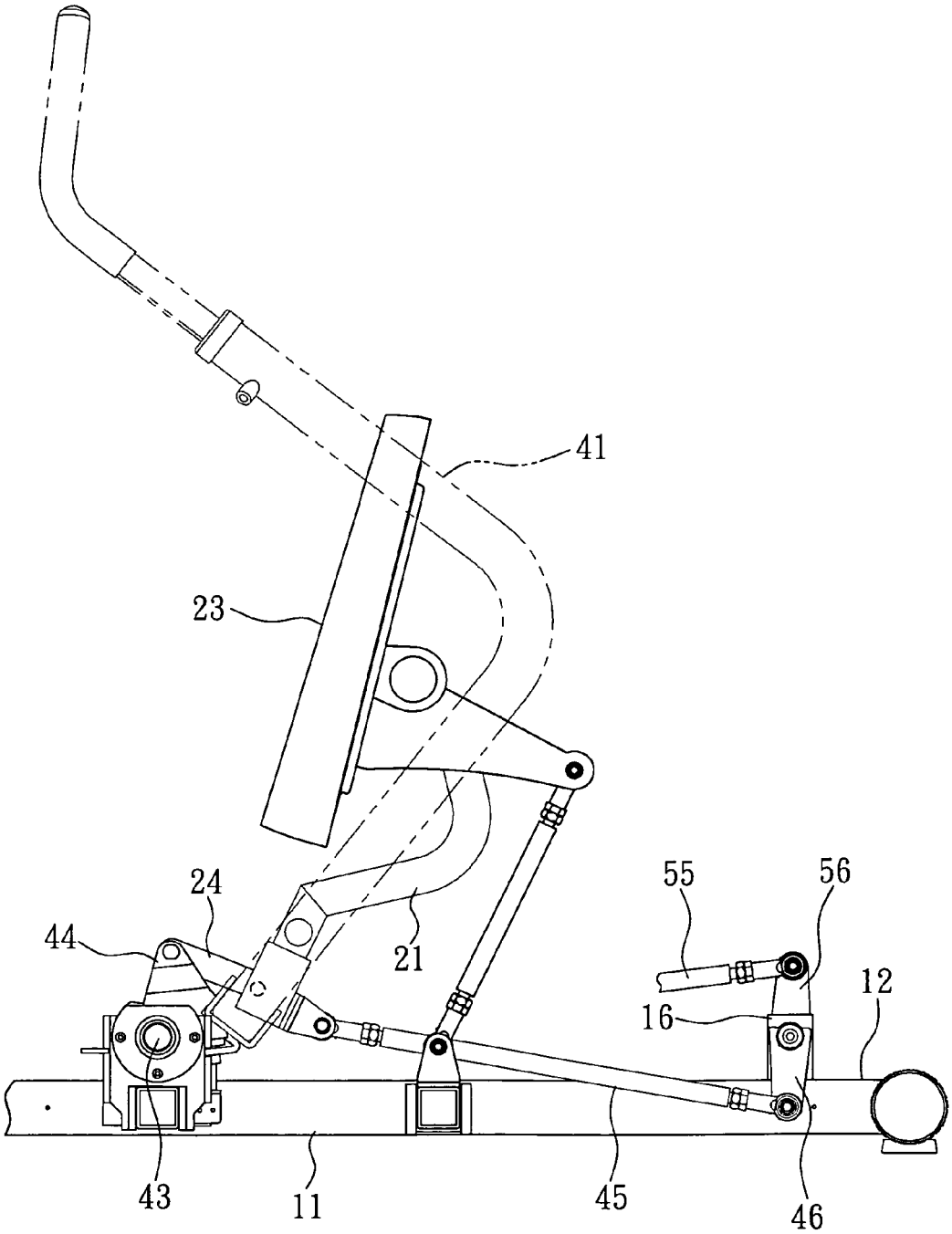
FIG. 5 shows the initial status of the right swinging arm before it is operated.
Figure 6:
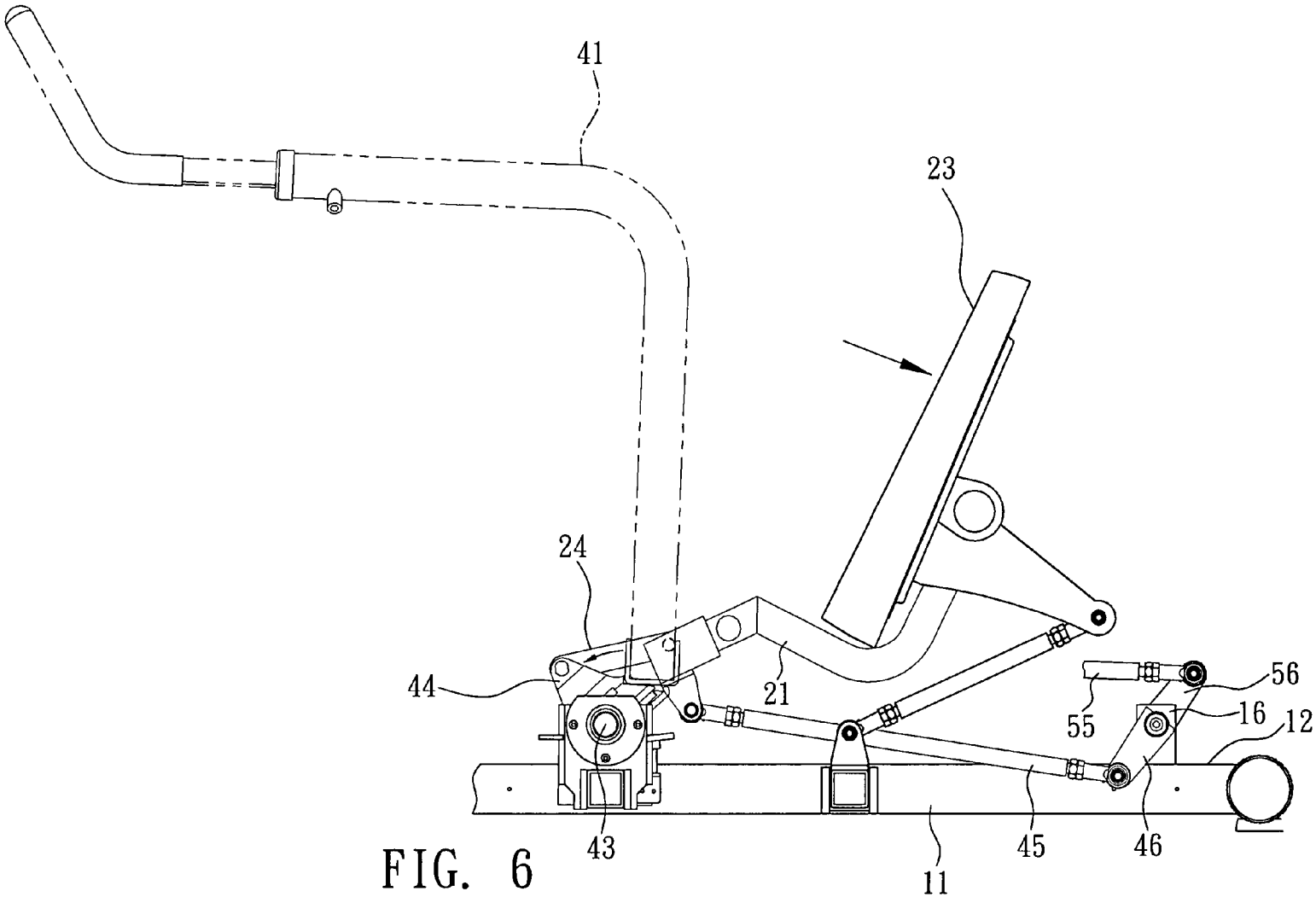
FIG. 6 shows that the right swinging arm is pivoted when the right pedal is operated.

As shown in FIGS. 5 and 6, when the right pedal 23 is pushed downward and drives the top end of the right link 21 forward, the first push link 24 drives the first connection link 44 of the right swinging arm 41 to move backward. The right swinging arm 41 moves toward the user and swings backward. The right rod 45 drives the right crank 46 which is rotated alternatively to the left crank 56 relative to the crank frame 16. The left crank 56 is rotated in opposite direction and drives the left rod 55 to move the left swinging arm 51 and the lower end of the left link 31 to swing forward. The left link 31 swings backward and the left pedal 33 moves toward the user and backward. The alternative operation of the hands and legs is then completed.

When the left pedal 33 is moved downward, the right pedal 23 moves toward the user and backward. The right swinging arm 41 moves away from the user and the left swinging arm 51 moves toward the user and backward. By this way, the user can operate the hands and legs repeatedly.

Figure 7:
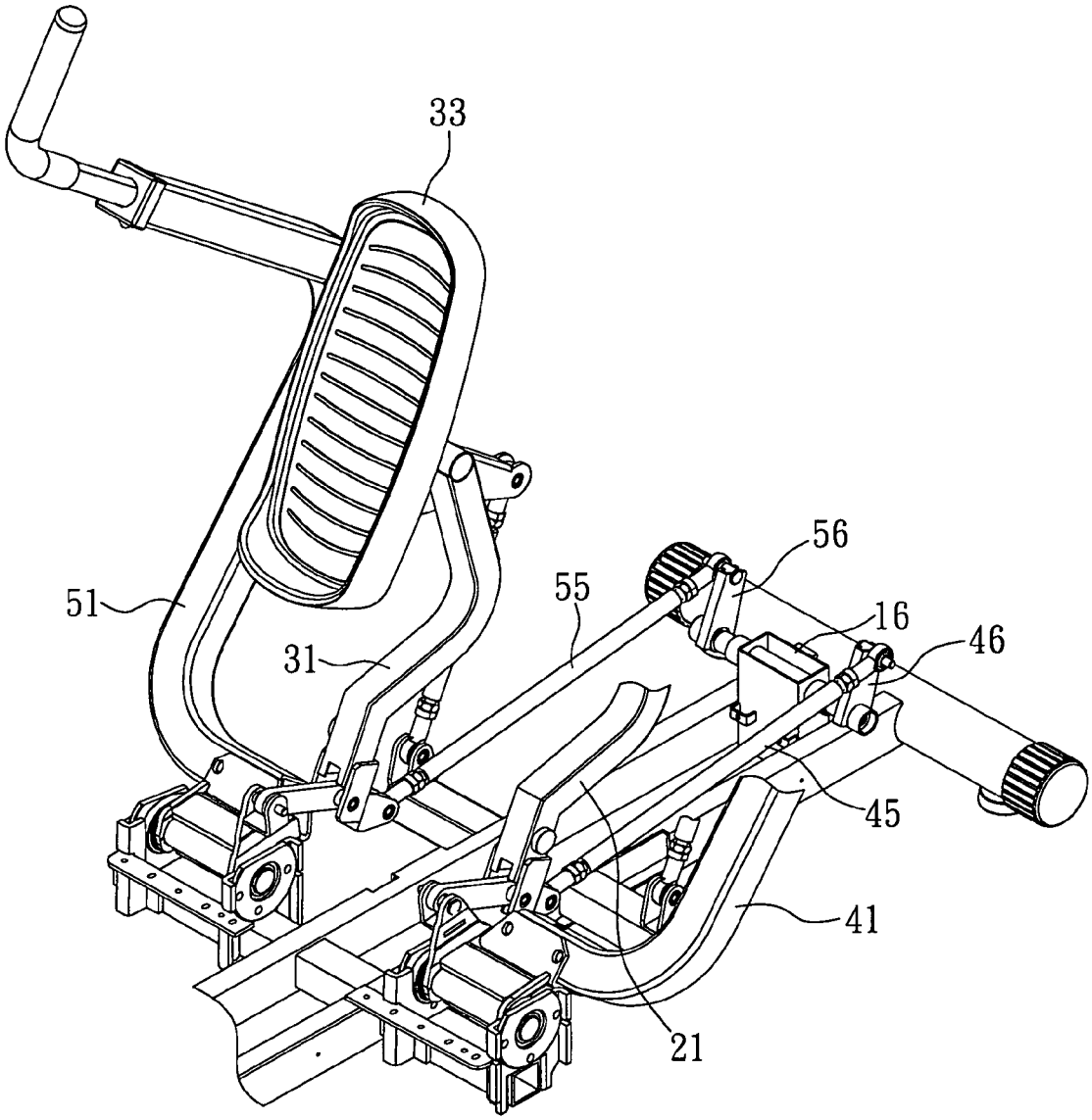
FIG. 7 shows that the right crank and the left crank extend toward the same direction relative to the crank frame.
Figure 8:
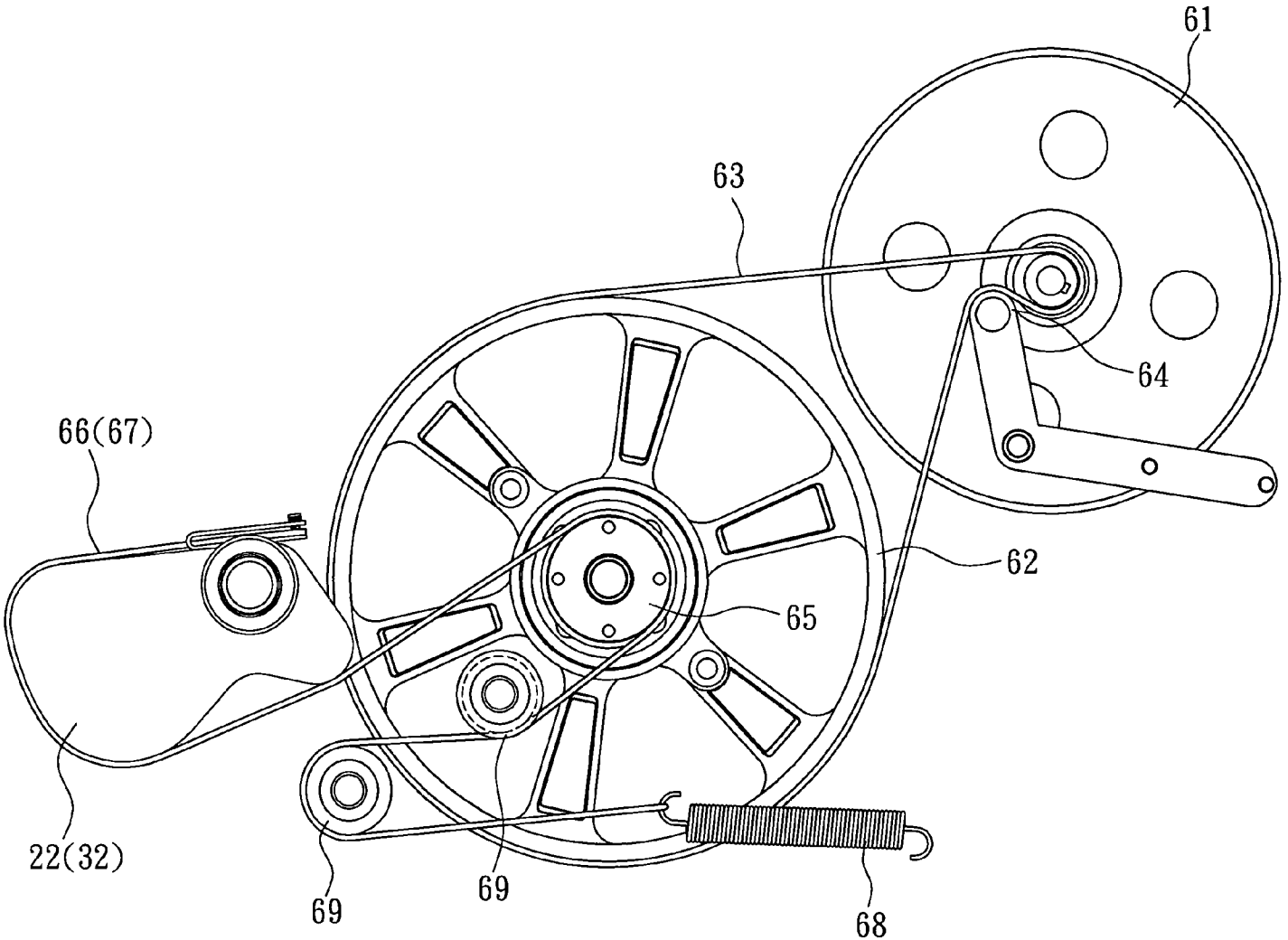
FIG. 8 shows that the right crank and the left crank extend toward the same direction relative to the crank frame while the cam is about to rotated.
Figure 9:
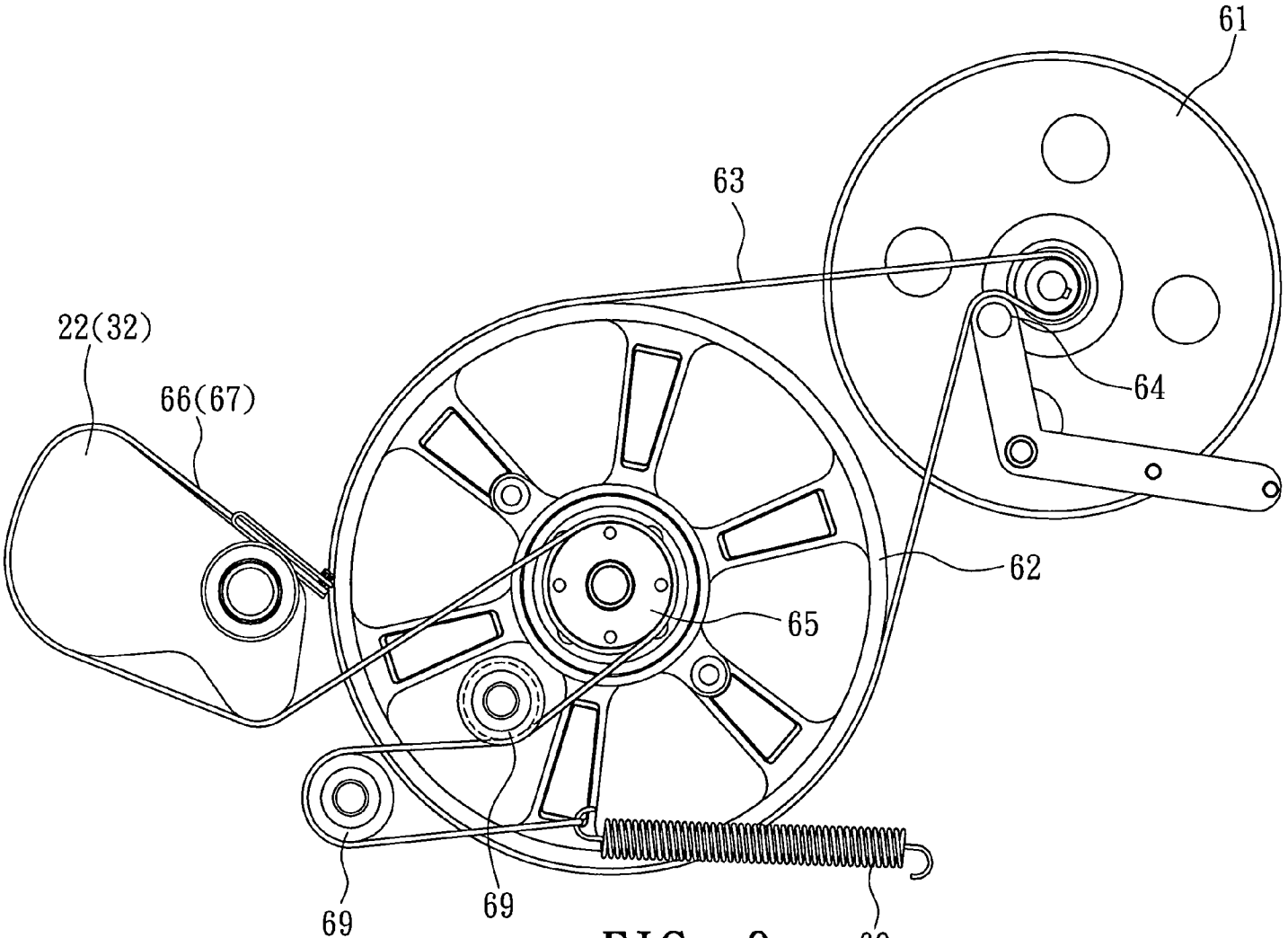
FIG. 9 shows that the right crank and the left crank extend toward the same direction relative to the crank frame while the cam is rotated.

As shown in FIGS. 7 to 9, when the right and left cranks 46, 56 extend toward the same direction relative to the crank frame 16, the left crank 56 drives the left rod 55 which moves the left swinging arm 51 toward backward, the lower end of the left link 31 moves backward so that the top end of the left link 31 moves forward. The left pedal 33 moves away from the user so that the user performs a rowing action.

Due to the one-way bearings 65 of the right and left cams 22, 32, the passive wheel 62 is individually driven to activate the resistance unit 61 to generate a resistance. Therefore, the right and left links 21, 31 and the right and left swinging arms 41, 51 travel at the same speed and the resistance is the same. This makes the operation of the recumbent exerciser of the present invention smooth. Besides, the profile of the cams can be made to be different so as to obtain different tangent forces of the transmission belt and different swinging speeds. By adjustment of the lengths of the right and left rods 45, 55, the exerciser can be adjusted to meet different requirement of different users.

The two cams 22, 32 can drive the passive wheel 62 in one direction so as to activate the resistance unit 61 to generate a resistance to drive the two swinging arms 41, 51 and the two rods 45, 55 to provide full range of exercise to the user's hands and legs.

The recumbent exerciser provides consistent resistance to the right side and left of the exerciser by the two cams so that the exercising result is satisfied. The operational direction of the user's hands is opposite to the operational direction of the user's legs. This feature allows the user to operate the recumbent exerciser more smoothly. The transmission unit and the resistance unit are located at the front section of the base and the seat is located at the rear section of the base, so that the seat does not need to be removed from the base when maintaining the transmission unit and the resistance unit. The right and left cranks extend toward the same direction so that the user can perform rowing action. The profile of the cams can be made to be different so as to obtain different tangent forces of the transmission belt and different swinging speeds. By adjustment of the lengths of the right and left rods, the exerciser can be adjusted to meet different requirement of different users.

While we have shown and described the embodiment in accordance with the present invention, it should be clear to those skilled in the art that further embodiments may be made without departing from the scope of the present invention.

What is claimed is:

1. A recumbent exerciser comprising:

a base extending in a longitudinal direction and having a front section and a rear section;

a right link and a left link pivotably connected on two sides of the base and located at the front section of the base, a right cam and a left cam connected to the right link and the left link respectively each of said right and left cams being rotatable in a plane parallel to said longitudinal direction of said base and responsive to a rotation of said right and left links in a plane parallel to said longitudinal direction of said base, a right pedal and a left pedal connected to two respective top ends of the right link and the left link, a right swinging arm and a left swinging arm connected to the right link and the left link; the right link and the left link being pivoted to drive the right cam, the left cam, the right swinging arm and the left swinging arm by operation of the right pedal and the left pedal said right and left swinging arms being driven in a longitudinal direction responsive to said rotation of said right and left cams; said right link and the left link have a first push link and a second push link connected to two respective distal ends thereof respectively, the right swinging arm and the left swinging arm are pivotably connected to the two sides of the front section of the base by two respective lower ends thereof, two respective top ends of the right swinging arm and the left swinging arm have a right grip and a left grip connected thereto respectively, a first connection link and a second connection link are respectively connected to two respective lower ends of the right swinging arm and the left swinging arm, the right swinging arm and the left swinging arm are driven by the right link and the left link whereby the right swinging arm and the left swinging arm are displaced in an opposite direction with respect to a respective displacement of said right and left link displacement;

a resistance unit connected to the front section of the base and driven by a passive wheel which includes two respective one-way bearings on two sides thereof, the right cam and the left cam connected to the two respective one-way bearings by a right belt and a left belt respectively, the right cam and the left cam driving the passive wheel in one direction and driving the resistance unit to generate a resistance when the right link and the left link are operated to drive the right cam and the left cam; and a seat connected to the rear section of the base and located remote from the resistance unit.

2. The exerciser as claimed in claim 1, wherein the right belt and the left belt are two timing belts.

3. The exerciser as claimed in claim 1, wherein the right link and the left link are pivotably connected to two respective first ends of a right rod and a left rod, two respective second ends of the right rod and the left rod are pivotably connected to a right crank and a left crank respectively, the right crank and the left crank are pivotably connected to a crank frame on the front section of the base, the right crank and the left crank pivot about the crank frame to extend toward opposite directions.

4. The exerciser as claimed in claim 1, wherein the right link and the left link are pivotably connected to two respective first ends of a right rod and a left rod, two respective second ends of the right rod and the left rod are pivotably connected to a right crank and a left crank respectively, the right crank and the left crank are pivotably connected to a crank frame on the front section of the base, the right crank and the left crank pivot about the crank frame to extend toward the same direction.

5. The exerciser as claimed in claim 1, wherein the resistance unit is connected to the passive wheel by a transmission belt, and an idler pulley presses the transmission belt.

6. The exerciser as claimed in claim 1, wherein the right belt and the left belt have two respective first ends fixed to the right cam and the left cam respectively and two respective second ends of the right belt and the left belt go through the one-way bearings and are connected to two respective springs so as to be connected to the front section of the base, at least one idler pulley presses each of the right belt and the left belt.

7. The exerciser as claimed in claim 1, wherein a connection unit is connected to the rear section of the base and the seat is adjustably connected to the connection unit.

* * * * *